US011255235B2

(12) United States Patent
Lee

(10) Patent No.: US 11,255,235 B2
(45) Date of Patent: Feb. 22, 2022

(54) METHOD AND DEVICE FOR CONTROLLING ENGINE OIL PUMP OF VEHICLE

(71) Applicants: HYUNDAI MOTOR COMPANY, Seoul (KR); KIA MOTORS CORPORATION, Seoul (KR)

(72) Inventor: Minyong Lee, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 17/078,782

(22) Filed: Oct. 23, 2020

(65) Prior Publication Data

US 2021/0180483 A1 Jun. 17, 2021

(30) Foreign Application Priority Data

Dec. 16, 2019 (KR) ..... 10-2019-0167707

(51) Int. Cl.
*F01M 1/16* (2006.01)

(52) U.S. Cl.
CPC ..... *F01M 1/16* (2013.01); *F01M 2250/60* (2013.01)

(58) Field of Classification Search
CPC ..... F01M 1/16; F01M 2250/60
See application file for complete search history.

(56) References Cited

U.S. PATENT DOCUMENTS

2019/0242279 A1* 8/2019 Dudar ..... F01M 1/02

* cited by examiner

*Primary Examiner* — Jacob M Amick
(74) *Attorney, Agent, or Firm* — Lempia Summerfield Katz LLC

(57) ABSTRACT

A method for controlling an engine oil pump of a vehicle includes: starting, by a controller, an engine of the vehicle; determining, by the controller, whether a number of starting repetition of the engine exceeds a number reference value after the engine is started; and when the number of starting repetition of the engine exceeds the number reference value, controlling, by the controller, a flow amount of an oil pump of the engine to be a flow amount that is less than a flow amount reference value and decreasing the flow amount of the oil pump in proportion to an increase in the number of starting repetition to reduce an oil pressure of the engine. The flow amount reference value of the oil pump is an operating value of the oil pump generated when a fuel does not flow into an engine oil of the engine.

12 Claims, 3 Drawing Sheets

FIG. 3

| Coolant temperature of engine(℃) | -30℃ | -20℃ | -10℃ | 0℃ | 30℃ |
|---|---|---|---|---|---|
| Oil pressure control factor | 0.85 | 0.88 | 0.90 | 0.95 | 1.00 |
| Time to reach second temperature reference value | | 100 seconds | 200 seconds | 300 seconds | 500 seconds |
| Oil pressure control factor | | 1.00 | 0.95 | 0.93 | 0.90 |

METHOD AND DEVICE FOR CONTROLLING ENGINE OIL PUMP OF VEHICLE

CROSS-REFERENCE TO RELATED APPLICATION

This application claims priority to and the benefit of Korean Patent Application No. 10-2019-0167707, filed on Dec. 16, 2019, the entire contents of which are incorporated herein by reference.

FIELD

The present disclosure relates to an engine of a vehicle, and more particularly, to a method and a device for controlling an engine oil pump of a vehicle.

BACKGROUND

The statements in this section merely provide background information related to the present disclosure and may not constitute prior art.

In general, an engine oil pump is a device that supplies lubrication oil to a friction movement part of an engine in order to smooth an operation of the engine.

The engine oil pump rotates according to rotation of the engine to improve cooling of the engine using circulation of the engine oil, and circulates the engine oil in an oil pan as the engine oil pump rotates.

The engine hydraulic pump supplies the engine oil from the oil pan to each lubrication part of the engine through a filter (e.g., an oil filter). A relief valve is installed in a circulation circuit of the engine oil to prevent a hydraulic pressure from rising to a dangerous level. The oil that reaches each lubrication part of the engine falls back to the oil pan after lubrication is finished.

The engine oil pump is driven by a crankshaft of the engine as being directly connected to the crankshaft or being connected to the crankshaft through a gear or a chain, and generates a hydraulic pressure in proportion to a rotation speed of the engine.

This oil pump always supplies a certain amount of oil to the engine according to the rotation speed of the engine. Excess oil is drained or returned to the oil pan by the relief valve.

A drive shaft of the oil pump is connected to the crankshaft at a constant rotation ratio, so an oil pressure of the oil pump increases in proportion to the engine speed. When the engine speed is low, the oil pressure is too low so that problems arise in lubrication of each driving part of the engine. When the engine speed is high, the oil pressure is excessively high and energy is excessively lost in the oil pump so that fuel efficiency of the engine deteriorates.

In order to solve the above problems, a two-stage variable oil pump has been proposed. The two-stage variable oil pump controls the oil pressure to be low in a high-speed mode of the engine where fuel efficiency is important, and controls the oil pressure to be high in a low-speed mode of the engine where durability is important. The two-stage variable oil pump is implemented through on and off control of a solenoid valve.

The above information disclosed in this Background section is only for enhancement of understanding of the background of the present disclosure, and therefore it may contain information that does not form the prior art that is already known to a person of ordinary skill in the art.

SUMMARY

The present disclosure provides a method and a device for controlling an engine oil pump of a vehicle capable of controlling the engine oil pump based on an amount of a fuel flowing into engine oil supplied by the engine oil pump.

In an exemplary form of the present disclosure, the method for controlling the engine oil pump of the vehicle may include: starting, by a controller, an engine of the vehicle; determining, by the controller, whether a number of starting repetition of the engine exceeds a number reference value after the engine is started; and when the number of starting repetition of the engine exceeds the number reference value, controlling, by the controller, a flow amount of an oil pump of the engine to be a flow amount that is less than a flow amount reference value, and decreasing the flow amount of the oil pump in proportion to an increase in the number of starting repetition so as to reduce the oil pressure of the engine. The flow amount reference value of the oil pump may be an operating value of the oil pump generated when a fuel does not flow into an engine oil of the engine.

The method for controlling the engine oil pump of the vehicle may further include: operating, by the controller, the oil pump of the engine so that an oil pressure of the engine becomes a basic value when the number of starting repetition of the engine is less than or equal to the number reference value. The basic value may be a value corresponding to the flow amount reference value of the oil pump.

The method for controlling the engine oil pump of the vehicle may further include: determining, by the controller, whether a coolant temperature of the engine is less than a first temperature reference value after the engine is started. When the coolant temperature of the engine is less than the first temperature reference value, the controller may be configured to control the flow amount of the oil pump of the engine to be a flow amount that is less than the flow amount reference value and decrease the flow amount of the oil pump in proportion to an decrease in the coolant temperature of the engine so as to reduce the oil pressure of the engine.

The method for controlling the engine oil pump of the vehicle may further include: operating, by the controller, the oil pump of the engine so that an oil pressure of the engine becomes a basic value when the coolant temperature of the engine is greater than or equal to the first temperature reference value. The basic value may be a value corresponding to the flow amount reference value of the oil pump.

The method for controlling the engine oil pump of the vehicle may further include: determining, by the controller, whether a time period during which the coolant temperature of the engine reaches a second temperature reference value exceeds a time period reference value after the engine is started. When the time period during which the coolant temperature of the engine reaches the second temperature reference value exceeds the time period reference value, the controller may be configured to control the flow amount of the oil pump of the engine to be a flow amount that is less than the flow amount reference value and decrease the flow amount of the oil pump in proportion to an increase in the time period to reduce the oil pressure of the engine.

The method for controlling the engine oil pump of the vehicle may further include: operating, by the controller, the oil pump of the engine so that an oil pressure of the engine becomes a basic value when the time period during which the coolant temperature of the engine reaches the second temperature reference value is less than or equal to the time period reference value. The basic value may be a value corresponding to the flow amount reference value of the oil pump.

In another form of the present disclosure, a device for controlling the engine oil pump of the vehicle may include: an information detector configured to detect a starting repetition number of an engine of the vehicle; and a controller configured to determine whether the starting repetition number of the engine exceeds a number reference value. When the starting repetition number of the engine exceeds the number reference value, the controller may be configured to control a flow amount of an oil pump of the engine to be a flow amount that is less than a flow amount reference value and decrease the flow amount of the oil pump in proportion to an increase in the starting repetition number increases to reduce an oil pressure of the engine. The flow amount reference value of the oil pump may be an operating value of the oil pump generated when a fuel does not flow into an engine oil of the engine.

The controller may be configured to operate the oil pump of the engine so that the oil pressure of the engine becomes a basic value when the starting repetition number of the engine is less than or equal to the number reference value. The basic value may be a value corresponding to the flow amount reference value of the oil pump.

The controller may be configured to determine whether a coolant temperature of the engine is less than a first temperature reference value after the engine is started. When the coolant temperature of the engine is less than the first temperature reference value, the controller may be configured to control the flow amount of the oil pump of the engine to be a flow amount that is less than the flow amount reference value and decrease the flow amount of the oil pump in proportion to an decrease in the coolant temperature of the engine so as to reduce the oil pressure of the engine.

The controller may be configured to operate the oil pump of the engine so that an oil pressure of the engine becomes a basic value when the coolant temperature of the engine is greater than or equal to the first temperature reference value. The basic value may be a value corresponding to the flow amount reference value of the oil pump.

The controller may be configured to determine whether a time period during which the coolant temperature of the engine reaches a second temperature reference value exceeds a time period reference value after the engine is started. When the time period during which the coolant temperature of the engine reaches the second temperature reference value exceeds the time period reference value, the controller may be configured to control a flow amount of the oil pump of the engine to be a flow amount that is less than the flow amount reference value and decrease the flow amount of the oil pump in proportion to an increase in the time period to reduce the oil pressure of the engine.

The controller may be configured to operate the oil pump of the engine so that an oil pressure of the engine becomes a basic value when the time period during which the coolant temperature of the engine reaches the second temperature reference value is less than or equal to the time period reference value. The basic value may be a value corresponding to the flow amount reference value of the oil pump.

The method and the device for controlling the engine oil pump of the vehicle according to the exemplary form of the present disclosure may control the engine oil pump based on the amount of the fuel flowing into the engine oil.

Further, the exemplary form of the present disclosure may control a target pressure of the engine oil to be less than an initially set pressure in order to cope with a pressure drop of the engine oil due to decrease in a viscosity of the engine oil generated based on the amount of the fuel flowing into the engine oil according to a driving condition of the vehicle. Therefore, an engine control error generated due to the pressure drop of the engine oil may be prevented so that an engine warning lamp (e.g., an engine check lamp) is not turned on and drivability of the vehicle is improved.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 3 is a table explaining an example of a control factor that controls the engine oil pump shown in FIG. 2.

Figure 1:
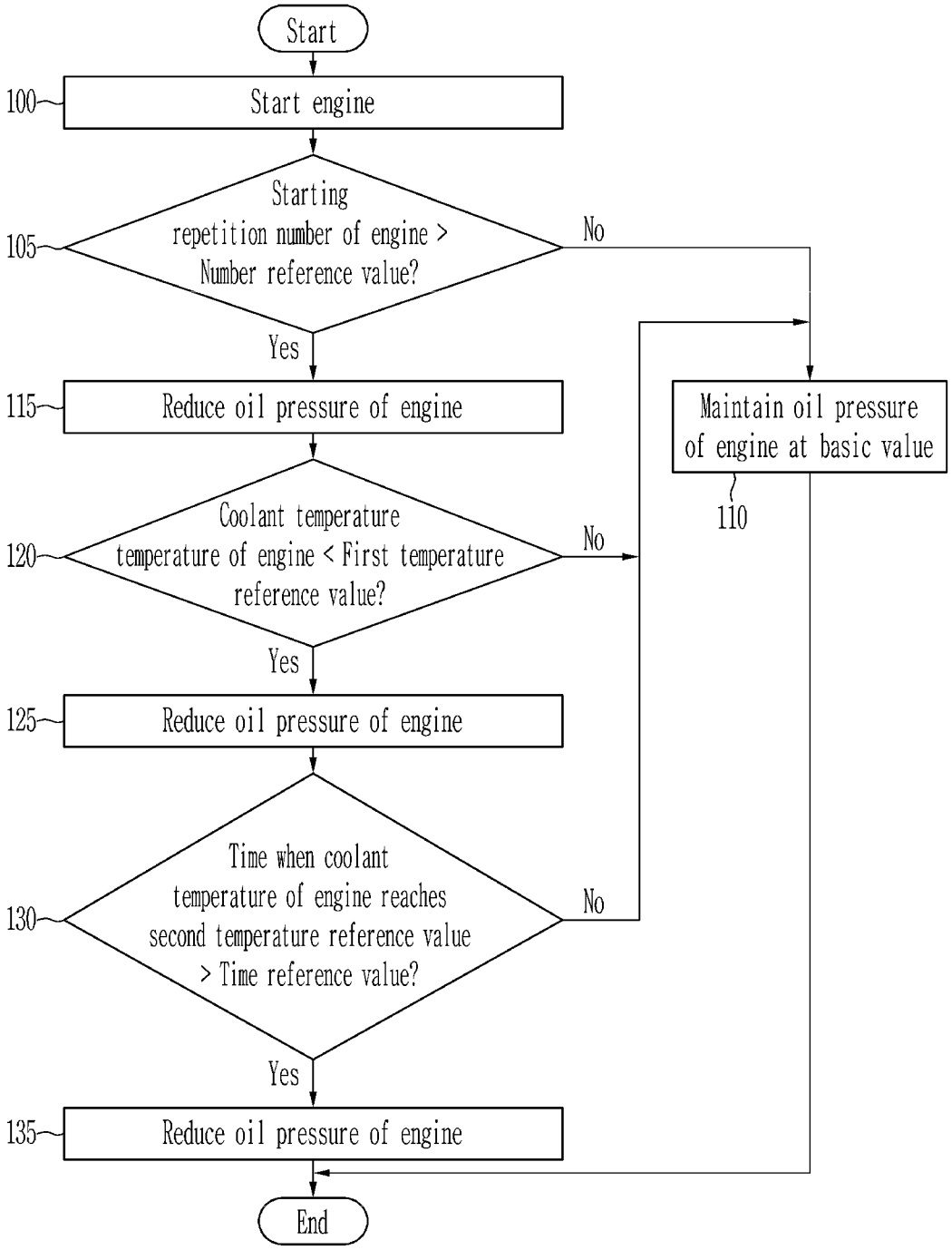
FIG. 1 is a flowchart illustrating a method for controlling an engine oil pump of a vehicle according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In order to sufficiently understand the present disclosure and the object achieved by embodying the present disclosure, the accompanying drawings illustrating exemplary forms of the present disclosure and contents described in the accompanying drawings are to be referenced.

Hereinafter, the present disclosure will be described in detail by describing exemplary forms of the present disclosure with reference to the accompanying drawings. In describing the present disclosure, well-known configurations or functions will not be described in detail since they may unnecessarily obscure the gist of the present disclosure. Throughout the accompanying drawings, the same reference numerals will be used to denote the same components.

Terms used in the present specification are only used in order to describe specific exemplary forms rather than limiting the present disclosure. Singular forms are to include plural forms unless the context clearly indicates otherwise. It will be further understood that the terms "include" or "have" used in the present specification specify the presence of features, numerals, steps, operations, components, or parts mentioned in the present specification, or a combination thereof, but do not preclude the presence or addition of one or more other features, numerals, steps, operations, components, parts, or a combination thereof.

Throughout this specification and the claims that follow, when it is described that an element is "coupled" to another element, the element may be "directly coupled" to the other element or "electrically or mechanically coupled" to the other element through a third element.

Unless defined otherwise, it is to be understood that the terms used in the present specification including technical and scientific terms have the same meanings as those that are generally understood by those skilled in the art. It must be understood that the terms defined by the dictionary are identical with the meanings within the context of the related art, and they should not be ideally or excessively formally defined unless the context clearly dictates otherwise.

When a fuel supplied to an engine of a vehicle flows into an engine oil, the engine oil is diluted. This oil dilution phenomenon is likely to occur when starting of the engine is repeated and the vehicle drives at a low speed in a cryogenic area or a cold area in which fuel (e.g., an alcohol fuel or a fuel including alcohol) having a high level of drivability index is used.

When a temperature is low, a fuel evaporation rate of the fuel with the high level of drivability index may be reduced. When the engine is started in the cold area, an amount of fuel injection in the engine may be increased. Because the engine oil temperature is low in the cold area, the fuel evaporation rate may be reduced. In the cold area, the rate of fuel evaporation may be reduced because the vehicle's high-speed driving ratio is low. As a result, the fuel is likely to flow into the engine oil. When the fuel flows into the engine oil, a viscosity of the engine oil may decrease in proportion to an amount of the fuel flowing into the engine oil.

The related art controls the engine's oil pump so that a pressure of the engine oil becomes an initially set pressure regardless of the viscosity of the engine oil. Therefore, the related art may not follow a target pressure of the engine oil due to the decreased viscosity of the engine oil. In addition, the related art may generate an engine control error corresponding to a decreased pressure of the engine oil due to the decreased viscosity of the engine oil so that the engine check lamp is turned on.

Figure 2:
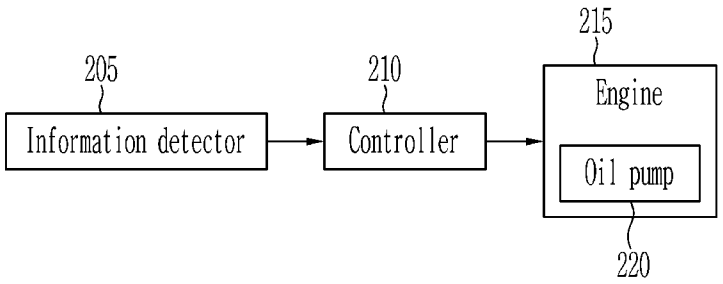
FIG. 2 is a block diagram illustrating a device for controlling the engine oil pump of the vehicle according to an exemplary form of the present disclosure.

FIG. 1 is a flowchart illustrating a method for controlling an engine oil pump of a vehicle according to an exemplary form of the present disclosure. FIG. 2 is a block diagram illustrating a device for controlling the engine oil pump of the vehicle according to an exemplary form of the present disclosure. FIG. 3 is a table explaining an example of a control factor that controls the engine oil pump shown in FIG. 2.

Referring to FIG. 1 through FIG. 3, in a starting step 100, a controller 210 may start an engine 215 of the vehicle. For example, the controller 210 may start the engine 215 by operating a start motor.

As shown in FIG. 2, the device for controlling the engine oil pump of the vehicle may include an information detector 205, a controller 210, and an engine 215 such as a diesel engine or gasoline engine.

The controller 210 may be an electronic control unit (ECU) and may control an entire operation of the vehicle including the device for controlling the engine oil pump of the vehicle. For example, the controller 210 may be one or more microprocessors operated by a program or hardware (e.g., a microcomputer) including the microprocessor. The program may include a series of commands for executing the method for controlling the engine oil pump of the vehicle according to the exemplary form of the present disclosure. The commands may be stored in a memory of the device for controlling the engine oil pump of the vehicle.

The information detector 205 may detect operation information of the vehicle and operation information of the engine 215. For example, the information detector 205 may include at least one sensor (e.g., a speed sensor or a coolant temperature sensor) detecting a speed of the vehicle, a starting repetition number of the engine 215, a rotation speed of the engine, a coolant temperature of the engine, or an oil temperature of the engine.

According to a determination step 105 shown in FIG. 1, after the engine 215 is started, the controller 210 may determine whether a number of starting repetition of the engine exceeds a number reference value (e.g., 6 times). The number reference value may be determined by a test or an experiment and may be stored in the memory of the device for controlling the engine oil pump of the vehicle.

When the number of starting repetition of the engine 215 is less than or equal to the number reference value, the method for controlling the engine oil pump of the vehicle, which is a process, may proceed to a step 110. When the number of starting repetition of the engine 215 exceeds the number reference value, the process may proceed to a step 115.

When the number of starting repetition of the engine 215 is less than or equal to the number reference value, the controller 210 may control an oil pump 220 of the engine 215 so that an oil pressure of the engine is maintained at a basic value at step 110. The basic value may be an operating value of the oil pump 220 corresponding to a flow amount reference value or a flow rate reference value of the oil pump generated when a fuel does not flow into an engine oil of the engine. The fuel does not flow into the engine oil when the number of starting repetition of the engine 215 is less than or equal to the number reference value, a coolant temperature of the engine is greater than or equal to a first temperature reference value, or a time period during the coolant temperature of the engine reaches a second temperature reference value after the engine is started is less than or equal to a time period reference value. The oil pump 220 may circulate or supply engine oil in an oil pan of the engine 215 to an element (e.g., a lubrication part such as a piston or a cam) of the engine.

At step 115, when the number of starting repetition of the engine 215 exceeds the number reference value, the controller 210 may control a flow amount of the oil pump 220 of the engine 215 to be a flow amount that is less than the flow amount reference value. In this condition, the controller 210 may decrease the flow amount of the oil pump in proportion to an increase in the starting repetition number so as to reduce an oil pressure of the engine. The flow amount decrease with respect to the increase in the starting repetition number may be determined by a test or an experiment, and may be stored in the memory of the device for controlling the engine oil pump of the vehicle.

A flow amount of the oil pump 220 may be reduced when a rotation speed of the oil pump is reduced. For example, the flow amount of the oil pump 220 may be adjusted by controlling an opening value of a solenoid valve that is included in the oil pump and supplies oil to the engine 215 or by controlling a rotation speed of a motor of an electric engine oil pump included in the oil pump.

According to a step 120, after the engine 215 is started, the controller 210 may determine whether the coolant temperature of the engine is less than the first temperature reference value (e.g., 30 (° C.)). The first temperature reference value may be determined by a test or an experiment and may be stored in the memory of the device for controlling the engine oil pump of the vehicle.

When the coolant temperature of the engine 215 is greater than or equal to the first temperature reference value, the method for controlling the engine oil pump of the vehicle, which is the process, may proceed to the step 110. When the coolant temperature of the engine 215 is less than the first temperature reference value, the process may proceed to a step 125.

According to the step 125, as shown in FIG. 3, when the coolant temperature of the engine 215 is less than the first temperature reference value, the controller 210 may control a flow amount of the oil pump 220 of the engine 215 to be a flow amount that is less than the flow amount reference value. Under this control, the controller 210 may decrease the flow amount of the oil pump in proportion to an decrease in the coolant temperature of the engine so as to reduce an oil pressure of the engine. The flow amount decrease with respect to the decrease in the coolant temperature of the engine may be determined by a test or an experiment and may be stored in the memory of the device for controlling the engine oil pump of the vehicle.

Referring to FIG. 3, when the coolant temperature of the engine 215 is 30° C. which is an example of the first temperature reference value, the control factor of the controller 210 that controls the oil pump 220 may be 1. The control factor of 1 may correspond to a control value that generates the flow amount reference value of the oil pump 220 according to the first temperature reference value. When the coolant temperature of the engine 215 is −30 (° C.), the control factor of controller 210 that controls the oil pump 220 may be 0.85. The control factor of 0.85 may correspond to a control value that generates 85% of the flow amount reference value of the oil pump 220.

According to step 130 shown in FIG. 1, after the engine 215 is started, the controller 210 may determine whether the time period during which the coolant temperature of the engine reaches the second temperature reference value (e.g., 90° C.) exceeds the time period reference value (e.g., 100 seconds). The second temperature reference value and the time period reference value may be determined by a test or an experiment and may be stored in the memory of the device for controlling the engine oil pump of the vehicle.

When the time period during which the coolant temperature of the engine 215 reaches the second temperature reference value is less than or equal to the time period reference value, the method for controlling the engine oil pump of the vehicle, which is the process, may proceed to the step 110. When the time period during which the coolant temperature of the engine 215 reaches the second temperature reference value exceeds the time period reference value, the process may proceed to a step 135. A case in which the time period exceeds the time period reference value may correspond to a case in which the vehicle travels at a relatively low speed.

At step 135, as shown in FIG. 3, when the time period during which the coolant temperature of the engine 215 reaches the second temperature reference value exceeds the time period reference value, the controller 210 may control a flow amount of the oil pump 220 of the engine 215 to be a flow amount that is less than the flow amount reference value. Under this control, the controller 210 decreases the flow amount of the oil pump in proportion to an increase in the time period to reduce the oil pressure of the engine. The flow amount decrease with respect to the increase in the time period may be determined by a test or an experiment and may be stored in the memory of the device for controlling the engine oil pump of the vehicle.

Referring to FIG. 3, when the time period during which the coolant temperature of the engine 215 reaches the second temperature reference value is 100 seconds which is an example of the time period reference value, the control factor of the controller 210 that controls the oil pump 220 may be "1". The control factor of 1 may correspond to a control value that generates the flow amount reference value of the oil pump 220 according to the time period reference value. When the time period during which the coolant temperature of the engine 215 reaches the second temperature reference value is 500 seconds, the control factor of the controller 210 that controls the oil pump 220 may be "0.90". The control factor of 0.90 may correspond to a control value that generates 90% of the flow amount reference value of the oil pump 220.

When the steps 105, 120, and 130 are all satisfied, the control factors of the controller 210 used in steps 115, 125, and 145 and controlling the oil pump 220 may be used or applied simultaneously.

The components, "~unit", block, or module which are used in the present exemplary form may be implemented in software such as a task, a class, a subroutine, a process, an object, an execution thread, or a program which is performed in a predetermined region in the memory, or hardware such as a field programmable gate array (FPGA) or an application-specific integrated circuit (ASIC), and may be performed with a combination of the software and the hardware. The components, '~part', or the like may be embedded in a computer-readable storage medium, and some part thereof may be dispersedly distributed in a plurality of computers.

As set forth above, exemplary forms have been disclosed in the accompanying drawings and the specification. Herein, specific terms have been used, but are just used for the purpose of describing the present disclosure and are not used for qualifying the meaning or limiting the scope of the present disclosure, which is disclosed in the appended claims. Therefore, it will be understood by those skilled in the art that various modifications and equivalent exemplary forms are possible from the present disclosure.

DESCRIPTION OF SYMBOLS

205: information detector
210: controller
215: engine

What is claimed is:

1. A method for controlling an engine oil pump of a vehicle, the method comprising:

starting, by a controller, an engine of the vehicle;

determining, by the controller, whether a number of starting repetition of the engine exceeds a number reference value after the engine is started; and when the number of starting repetition of the engine exceeds the number reference value, controlling, by the controller, a flow amount of an oil pump of the engine to be a flow amount less than a flow amount reference value, and decreasing the flow amount of the oil pump in proportion to an increase in the number of starting repetition so as to reduce an oil pressure of the engine, wherein the flow amount reference value of the oil pump is an operating value of the oil pump generated when a fuel does not flow into an engine oil of the engine.

2. The method of claim 1, further comprising:

operating, by the controller, the oil pump of the engine so that the oil pressure of the engine becomes a basic value when the number of starting repetition of the engine is less than or equal to the number reference value, wherein the basic value is a value corresponding to the flow amount reference value of the oil pump.

3. The method of claim 1, further comprising:

determining, by the controller, whether a coolant temperature of the engine is less than a first temperature reference value after the engine is started; and when the coolant temperature of the engine is less than the first temperature reference value, controlling, by the controller, the flow amount of the oil pump of the engine to be the flow amount that is less than the flow amount reference value, and decreasing the flow amount of the oil pump in proportion to an decrease in the coolant temperature of the engine so as to reduce the oil pressure of the engine.

4. The method of claim 3, further comprising:

when the coolant temperature of the engine is greater than or equal to the first temperature reference value, controlling, by the controller, the oil pump of the engine so that the oil pressure of the engine becomes a basic value, wherein the basic value is a value corresponding to the flow amount reference value of the oil pump.

5. The method of claim 3, further comprising:

determining, by the controller, whether a time period during which the coolant temperature of the engine reaches a second temperature reference value exceeds a time period reference value after the engine is started; and when the time period exceeds the time period reference value, controlling, by the controller, the flow amount of the oil pump of the engine to be a flow amount that is less than the flow amount reference value, and decreasing the flow amount of the oil pump in proportion to an increase in the time period so as to reduce the oil pressure of the engine.

6. The method of claim 5, further comprising:

operating, by the controller, the oil pump of the engine so that the oil pressure of the engine becomes a basic value when the time period when the coolant temperature of the engine reaches the second temperature reference value is less than or equal to the time period reference value, wherein the basic value is a value corresponding to the flow amount reference value of the oil pump.

7. A device for controlling an engine oil pump of a vehicle, the device comprising:

an information detector configured to detect a starting repetition number of an engine of the vehicle; and a controller configured to determine whether the starting repetition number of the engine exceeds a number reference value, wherein when the starting repetition number of the engine exceeds the number reference value, the controller is configured to:

control a flow amount of an oil pump of the engine to be a flow amount less than a flow amount reference value, and decrease the flow amount of the oil pump in proportion to an increase in the starting repetition number so as to reduce an oil pressure of the engine, and wherein the flow amount reference value of the oil pump is an operating value of the oil pump generated when a fuel does not flow into an engine oil of the engine.

8. The device of claim 7, wherein the controller is configured to operate the oil pump of the engine so that the oil pressure of the engine becomes a basic value when the starting repetition number of the engine is less than or equal to the number reference value, and wherein the basic value is a value corresponding to the flow amount reference value of the oil pump.

9. The device of claim 7, wherein the controller is configured to determine whether a coolant temperature of the engine is less than a first temperature reference value after the engine is started, and wherein when the coolant temperature of the engine is less than the first temperature reference value, the controller is configured to:

control the flow amount of the oil pump of the engine to be the flow amount that is less than the flow amount reference value, and decrease the flow amount of the oil pump in proportion to an decrease in the coolant temperature of the engine so as to reduce the oil pressure of the engine.

10. The device of claim 9, wherein when the coolant temperature of the engine is greater than or equal to the first temperature reference value, the controller is configured to operate the oil pump of the engine so that the oil pressure of the engine becomes a basic value, and wherein the basic value is a value corresponding to the flow amount reference value of the oil pump.

11. The device of claim 9, wherein the controller is configured to determine whether a time period during which the coolant temperature of the engine reaches a second temperature reference value exceeds a time period reference value after the engine is started, and wherein when the time period exceeds the time period reference value, the controller is configured to: control the flow amount of the oil pump of the engine to be a flow amount that is less than the flow amount reference value, and decrease the flow amount of the oil pump in proportion to an increase in the time period so as to reduce the oil pressure of the engine.

12. The device of claim 11, wherein the controller is configured to operate the oil pump of the engine so that the oil pressure of the engine becomes a basic value when the time period during which the coolant temperature of the engine reaches the second temperature reference value is less than or equal to the time period reference value, and wherein the basic value is a value corresponding to the flow amount reference value of the oil pump.

* * * * *